US006363820B1

(12) United States Patent
Hsiao

(10) Patent No.: US 6,363,820 B1
(45) Date of Patent: Apr. 2, 2002

(54) HAND TOOL FOR DRIVING A FASTENER ABOUT AN AXIS

(76) Inventor: Chieh-Jen Hsiao, 2F, No. 215, Yu-Te Rd., Pei Dist., Taichung City (TW)

( * ) Notice: Subject to any disclaimer, the term of this patent is extended or adjusted under 35 U.S.C. 154(b) by 0 days.

(21) Appl. No.: 09/737,994

(22) Filed: Dec. 14, 2000

(51) Int. Cl.[7] ..... B25B 23/00

(52) U.S. Cl. ..... 81/439; 81/437; 81/177.4; 81/490

(58) Field of Search ..... 81/437, 439, 177.4, 81/490, 124.4, 124.5

(56) References Cited

U.S. PATENT DOCUMENTS

| | | | | |
|---|---|---|---|---|
| 4,300,607 A | * 11/1981 | Mellinger | 81/490 |
| 5,335,409 A | 8/1994 | Elvebak | 29/451 |
| 5,533,429 A | 7/1996 | Kozak | 81/439 |
| 5,881,615 A | * 3/1999 | Dahl et al. | 81/490 |
| 5,964,132 A | * 10/1999 | Chen | 81/439 |
| 6,029,549 A | * 2/2000 | Baker | 81/439 |

* cited by examiner

*Primary Examiner*—Joseph J. Hail, III
*Assistant Examiner*—David B. Thomas
(74) *Attorney, Agent, or Firm*—Skjerven Morrill MacPherson LLP

(57) ABSTRACT

A hand tool is used to drive a fastener about an axis, and includes a handle with an axially extending bore for receiving frictionally a fastener engaging member. The engaging member has an axially extending inner surrounding surface, and an inner peripheral wall which extends radially and inwardly to define a mounting hole communicating with the inner surrounding surface. A deformable member is inserted into the mounting hole, and has a protrusion extending inwardly of the inner surrounding surface when the engaging member is received in the handle. A bit, which includes two screwdriver tip ends and a shaft, is brought to be inserted into and is coupled to rotate with the engaging member axially such that the protrusion frictionally engages the shaft radially so as to hinder removal of the bit from the engaging member axially.

9 Claims, 5 Drawing Sheets

HAND TOOL FOR DRIVING A FASTENER ABOUT AN AXIS

BACKGROUND OF THE INVENTION

1. Field of the Invention

This invention relates to a hand tool for driving a fastener about an axis, more particularly to a hand tool with a handle and a bit which is detachably connected to the handle to perform multiple functions.

2. Description of the Related Art

A conventional hand tool, as described in U.S. Pat. No. 5,533,429, is disclosed to include a handle, a handle insert, and a fastener engaging portion which includes an elongated tube and two reversible screwdriver tips to be inserted into the handle insert. The handle insert releasably retains the fastener engaging portion by means of a detent which includes a ball and spring band arrangement for releasably gripping the fastener engaging portion. Such a hand tool is complicated in structure and entails a relatively high manufacturing cost.

Another hand tool, as described in U.S. Pat. No. 5,335,409, is disclosed to include a handle which defines an opening for receiving a bit. The opening has a shoulder for positioning an O-ring between the shoulder and an insert mounted to the handle within the opening. The bit is received in the handle and an opening through the insert such that the O-ring resiliently grips the exterior surface of the shaft of the bit to hold the bit in the handle with sufficient force to permit the bit to be held in the handle when the handle when the handle is grasped by the user during use. Although such a hand tool is simple in construction, there is a need to sleeve the O-ring and the insert on the shaft of the bit before assembly of the bit into the handle, thereby resulting in inconvenience during assembly of the bit.

SUMMARY OF THE INVENTION

The object of the present invention is to provide a hand tool which has a simple construction, which is easy to assemble, and which is relatively inexpensive to manufacture.

According to this invention, the hand tool includes a handle, a fastener engaging member, a resisting member, and a bit. The handle includes a first inner surrounding surface which is disposed around an axis and which defines a first bore that axially extends into the handle and that terminates at a blind end. The fastener engaging member includes a second outer surrounding surface to be forced frictionally into the first bore in an axial direction parallel to the axis, and a second inner surrounding surface which is surrounded by the second outer surrounding surface about the axis and which defines second and third bores opposite to each other in the axial direction and proximate and distal to the blind end respectively when the fastener engaging member is received into the handle. An inner peripheral wall extends radially to communicate the second outer surrounding surface with the second inner surrounding surface, and defines a mounting hole. The inner peripheral wall includes two end edge portions which are spaced apart from each other in the axial direction. A deformable member is inserted into the mounting hole in a direction radial to the axial direction, and includes a protrusion which extends in the radial direction and inwardly of the second inner surrounding surface. The resisting member is mounted in the inner peripheral wall to retain the deformable member in the mounting hole against movement in the radial direction when the fastener engaging member has been forced into the first bore, and has an abutment wall surface which abuts against the deformable member radially and inwardly. The bit includes two screwdriver tip ends axially opposite to each other, and a shaft which is disposed between and which interconnects the screwdriver tip ends. The shaft is brought to be inserted into the third bore in the axial direction such that one of the screwdriver tip ends is inserted into the second bore, and such that the protrusion of the deformable member frictionally engages the shaft in the radial direction so as to hinder removal of the bit from the fastener engaging member in the axial direction. A spline member is disposed between the shaft and the second inner surrounding surface to couple the former to rotate with the fastener engaging member when the handle is rotated by the user about the axis.

BRIEF DESCRIPTION OF THE DRAWINGS

Other features and advantages of the present invention will become apparent in the following detailed description of the preferred embodiments of the invention, with reference to the accompanying drawings, in which.

DETAILED DESCRIPTION OF THE PREFERRED EMBODIMENTS

Figure 1:
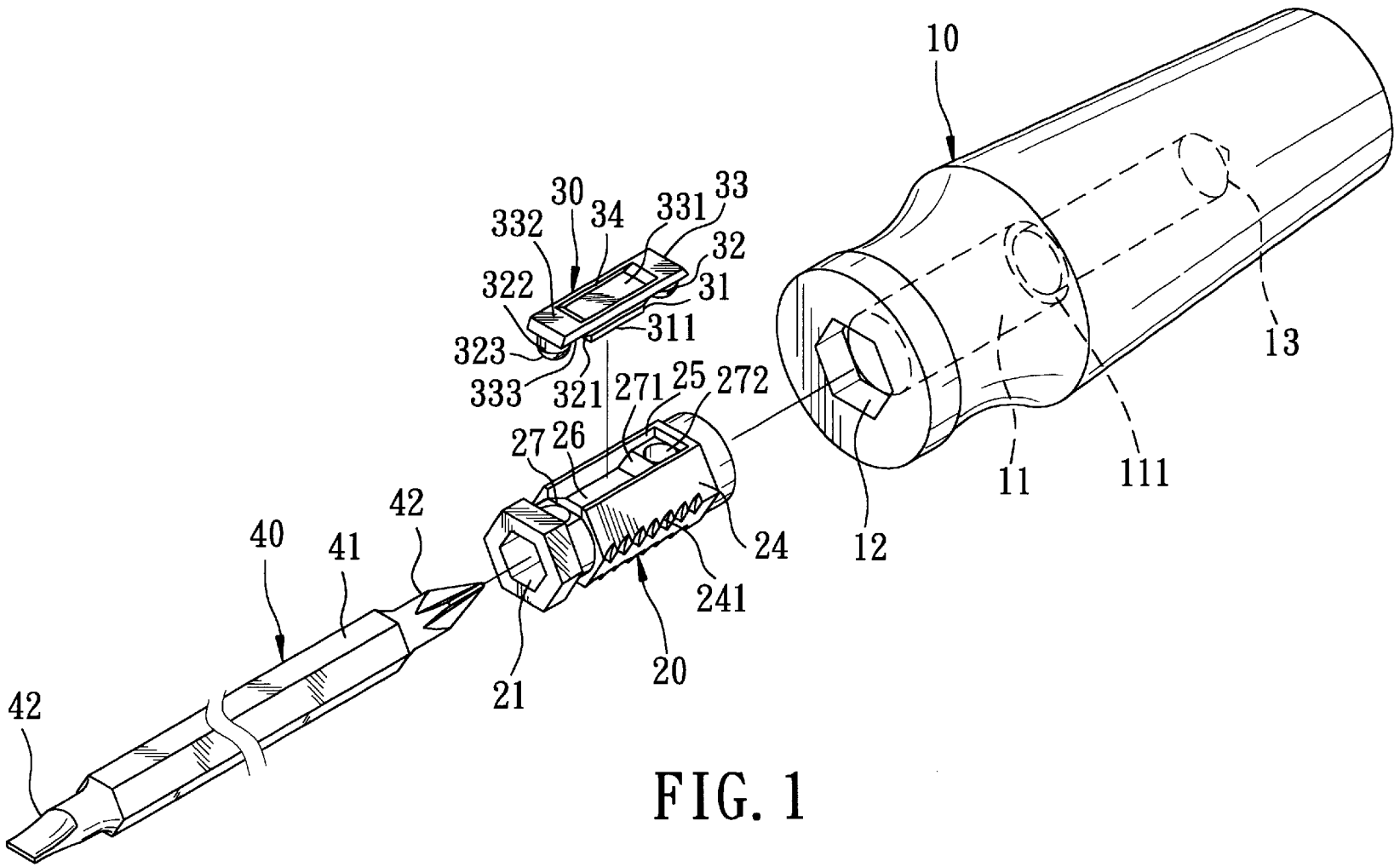
FIG. 1 is an exploded perspective view of a first preferred embodiment of a hand tool according to this invention.
Figure 2:
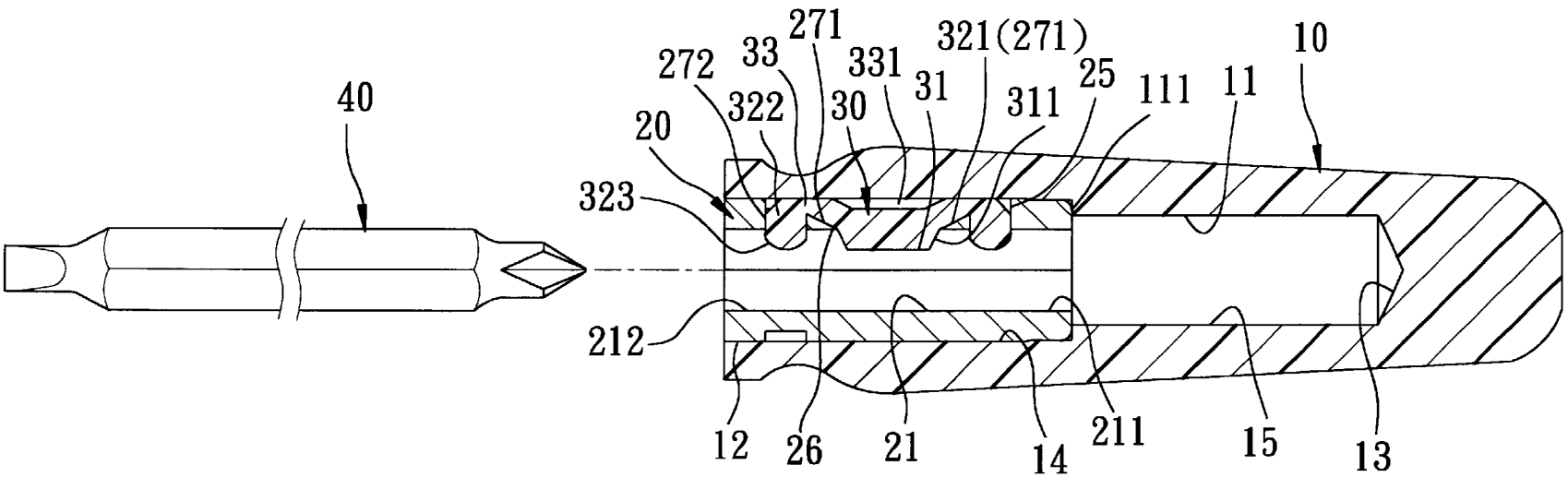
FIG. 2 is a sectional view showing the first preferred embodiment before a bit is mounted to a fastener engaging member.

Referring to FIGS. 1 and 2, the first preferred embodiment of the hand tool according to the present invention is shown to comprise a handle 10, a fastener engaging member 20, a resisting and deformable assembly 30, and a bit 40.

The handle 10 includes a first inner surrounding surface 11 which is disposed around an axis and which defines a first bore 12 that axially extends into the handle 10 and that terminates at a blind end 13. A shoulder 111 extends perpendicular to the axis to divide the first bore 12 into larger and small passages 14,15.

The fastener engaging member 20 is generally cylindrical, and includes a second outer surrounding surface 24 with a plurality of axially extending uni-directional serrations 241 and to be frictionally forced into the first bore 12 in an axial direction parallel to the axis until the foremost end of the fastener engaging member 20 abuts against the shoulder 111, and a second inner surrounding surface 21 which has a hexagonal cross-section and which is surrounded by the second outer surrounding surface 24 about the axis. The second inner surrounding surface 21 defines second and third bores 211,212 which extend axially and which are opposite to each other in the axial direction and proximate and distal to the blind end 13 respectively when the fastener engaging member 20 is received into the handle 10. A rectangular inner peripheral wall 25 extends in a direction radial to the axial direction to communicate the second outer surrounding surface 24 with the second inner surrounding surface 21, and defines a mounting hole 26. The inner peripheral wall 25 includes two end edge portions 27 which are spaced apart from each other in the axial direction. Each end edge portion 27 has a socket 272 which extends inwardly and radially to communicate with the second inner surrounding surface 21, and a mating wall 271 which is inclined inwardly from the socket 272 to the mounting hole 26.

The resisting and deformable assembly 30 is made of a deformable material, such as rubber, PVC, TPR, etc., and includes a rectangular resisting member 33 of such a dimension as to be disposed in the inner peripheral wall 25, and a deformable member 31. The resisting member 33 has a force transmitting wall surface 332 with a central recess 331, and an abutment wall surface 333 opposite to the force transmitting wall surface 332 in the radial direction to abut against the end edge portions 27 when the resisting member 33 is received in the inner peripheral wall 25. Two enhancing ribs 34 are formed on longer sides of the central recess 331. The deformable member 31 is connected integrally with the abutment wall surface 333, and has a protrusion 311 which is inserted into the mounting hole 26 and which extends radially and inwardly of the second inner surrounding surface 21. The deformable member 31 further has two tapered portions 321 which converge from the abutment wall surface 333 to the protrusion 311 so as to matingly engage the mating walls 271, respectively. A pair of plugs 32 have upper ends 322 which are connected to the abutment wall surface 333 at two sides of the deformable member 31, and lower ends 323 which are inserted into the sockets 272 in the radial direction so as to project inwardly of the second inner surrounding surface 21. The lower end 323 advantageously has a rounded portion to facilitate insertion into the respective socket 272.

Figure 3:
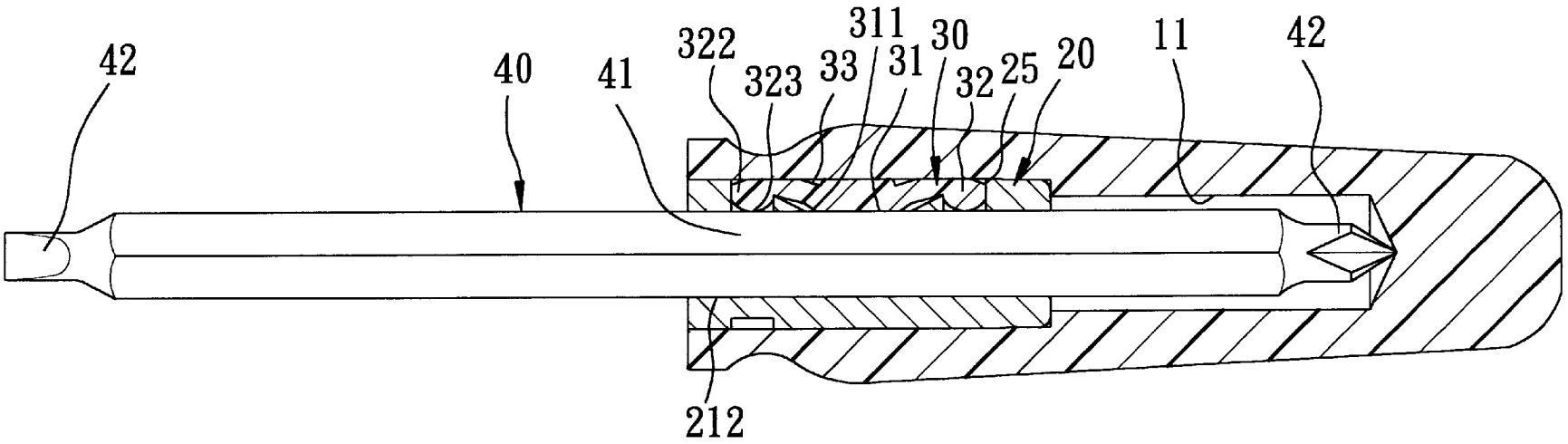
FIG. 3 is a sectional view showing the first preferred embodiment when the bit has been mounted to the fastener engaging member.

The bit 40 includes two screwdriver tip ends 42 which are shaped as a keystone screwdriver tip and a Phillips head tip respectively, and a shaft 41 which is disposed between and which interconnects the tip ends 42. The shaft 41 is of a hexagonal shape so as to matingly engage the hexagonal second inner surrounding surface 21 when the shaft 41 is brought to be forced into the third bore 212 in the axial direction until one of the tip ends 42 reaches the blind end 13, thereby resulting in a spline arrangement for coupling the shaft 41 to rotate with the fastener engaging member 20 when the handle 10 is rotated about the axis. As shown in FIG. 3, the protrusion 311 and the lower ends 323 of the plugs 32 are deformed by and frictionally engage the shaft 41 in the radial direction so as to hinder removal of the bit 40 from the fastener engaging member 20 in the axial direction.

In assembly, the resisting and deformable assembly 30 is first received in the inner peripheral wall 25 of the fastener engaging member 20 such that the protrusion 311 and the plugs 32 extend inwardly of the second inner surrounding surface 21 and such that the tapered portions 321 engage matingly the mating walls 271. Then, the fastener engaging member 20, which has the resisting and deformable assembly 30 mounted therein, is forced into the first inner surrounding surface 11 to be received in the larger passage 14, as shown in FIG. 2. In this state, the force transmitting wall surface 332 abuts against the first inner surrounding surface 11. By virtue of the serrations 241, the fastener engaging member 20 is secured in and is immobilized relative to the handle 10.

In use, as shown in FIG. 3, the bit 40 is inserted forcedly into the second inner surrounding surface 21 at one of the tip ends 42 via the third bore 212. By virtue of the deformable protrusion 311 and the plugs 32, the shaft 41 can be retained to the fastener engaging member 20 when the handle 10 is rotated during use.

The bit 40 can be forcibly detached from the fastener engaging member 20 against the frictions of the protrusion 311 and the plugs 32, so that the other one of the tip ends 42 can be inserted into the second inner surrounding surface 21.

As illustrated, the hand tool according to this invention is simple in structure. In addition, since the resisting and deformable assembly 30, which can hinder removal of the bit 40 from the fastener engaging member 20, has been previously disposed in the handle 10, assembly of the bit 40 is convenient to conduct.

Figure 4:
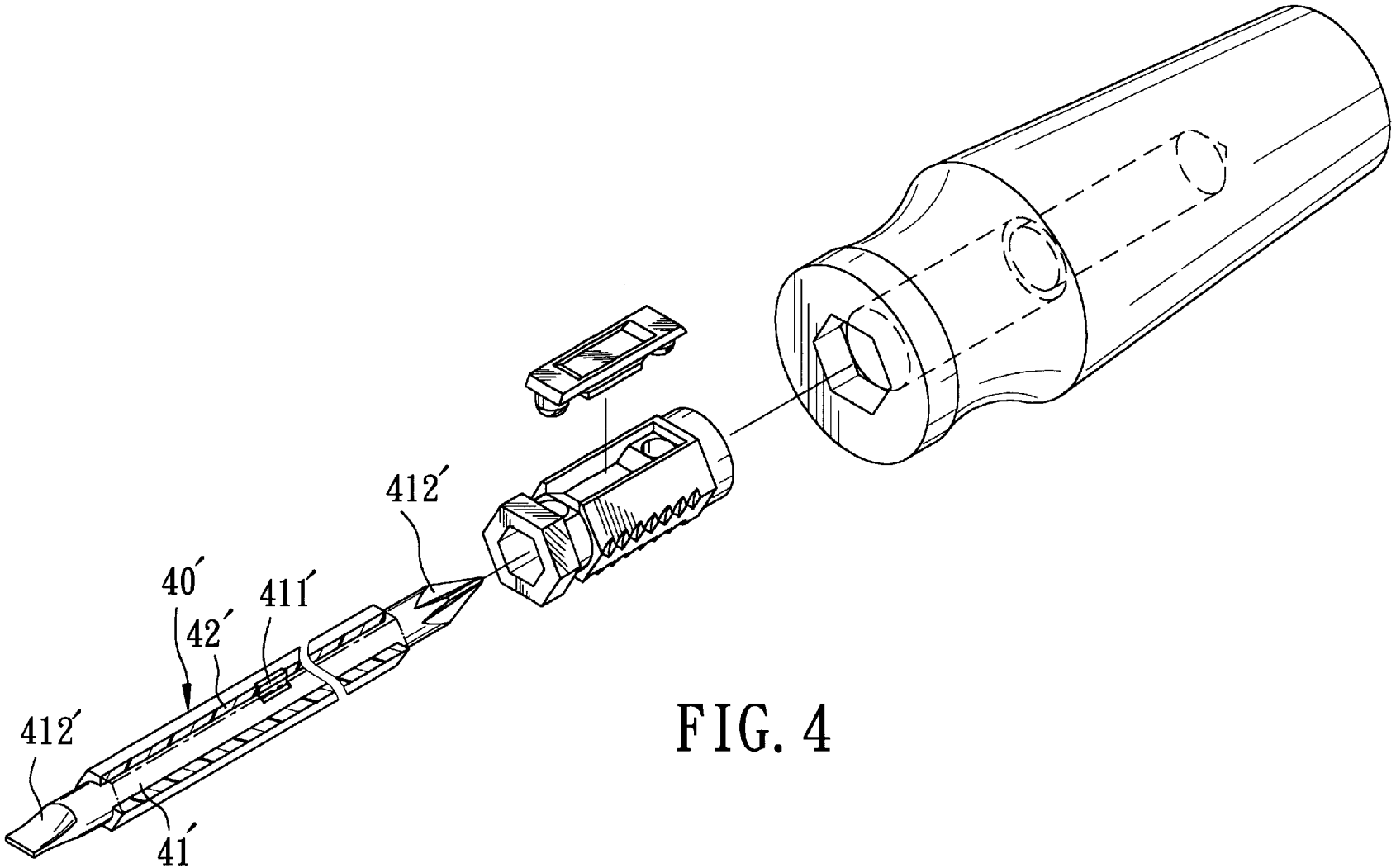
FIG. 4 is an exploded perspective view of a second preferred embodiment of a hand tool according to this invention.

As shown in FIG. 4, the second preferred embodiment of the hand tool according to this invention is shown to be similar to the previous embodiment in construction. The main difference resides in that the bit 40' includes a metal cylindrical shank 41' which has two screwdriver tip ends 412' and an intermediate portion between the tip ends 412' and that has two engaging members 411' formed thereon, and a rigid plastic sleeve 42' which is sleeved securely on the intermediate portion such that the material cost of the bit 40' can be reduced.

Figure 5:
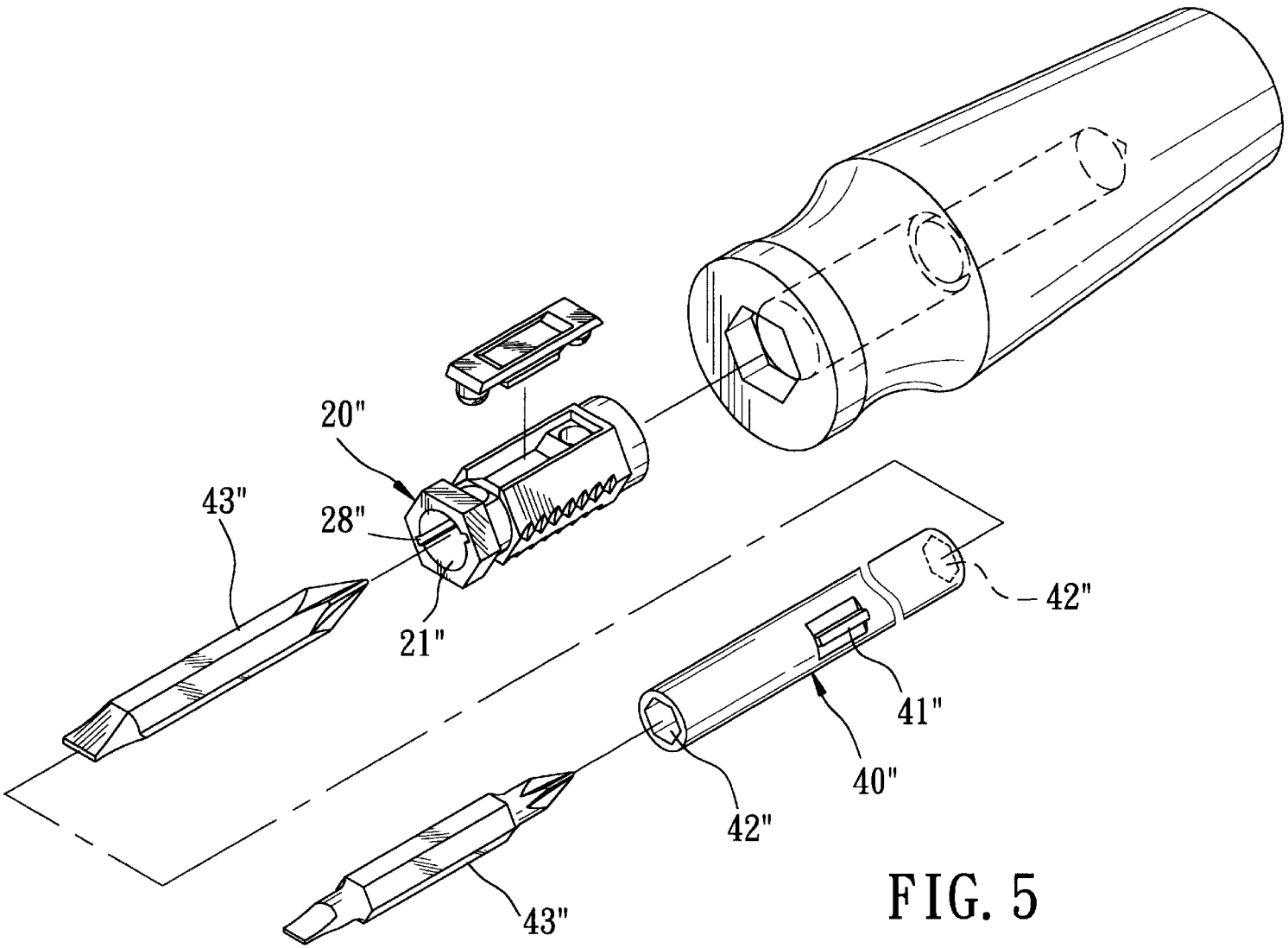
FIG. 5 is an exploded perspective view of a third preferred embodiment of a hand tool according to this invention.

The third preferred embodiment of the hand tool according to this invention is shown in FIG. 5 to be similar to the previous embodiments in construction. In contrast with the previous embodiments, the second inner surrounding surface 21" of the fastener engaging member 20" and the shaft 40" of the bit are of a circular cross-section. In addition, two keyways 28" and two keys 41" are formed in the second inner surrounding surface 21" and the shaft 40" respectively so as to engage matingly each other when the shaft 40" is inserted into the fastener engaging member 20", thereby resulting in a spline coupling arrangement. Moreover, the shaft 40" has an axially extending passage of a hexagonal shape and with two openings 42" such that two tips 43", each of which has two screwdriver tip ends and a hexagonal cross-section, can be connected to the openings 42", respectively.

While the present invention has been described in connection with what is considered the most practical and preferred embodiments, it is understood that this invention is not limited to the disclosed embodiments but is intended to cover various arrangements included within the spirit and scope of the broadest interpretations and equivalent arrangements.

I claim:

1. A hand tool for driving a fastener about an axis, comprising:

a handle including a first inner surrounding surface which is disposed around the axis and which defines a first bore axially extending into said handle and terminating at a blind end;

a fastener engaging member including a second outer surrounding surface of such a dimension as to be inserted into said first bore in an axial direction parallel to the axis, a second inner surrounding surface surrounded by said second outer surrounding surface about the axis and defining second and third bores axially extending and opposite to each other in the axial direction and proximate and distal to said blind end respectively when said fastener engaging member is received into said handle, and an inner peripheral wall extending radially to communicate said second outer surrounding surface with said second inner surrounding surface and defining a mounting hole, said inner peripheral wall including two end edge portions which are spaced apart from each other in the axial direction;

a friction member disposed between said second outer surrounding surface and said first inner surrounding surface to immobilize said fastener engaging member relative to said handle;

a deformable member of such a dimension as to be inserted into said mounting hole in a direction radial to the axial direction, and including a protrusion which extends in the radial direction and inwardly of said second inner surrounding surface;

a resisting member disposed to retain said deformable member in said mounting hole against movement in the radial direction when said fastener engaging member has been forced into said first bore, and having an abutment wall surface abutting against said deformable member radially and inwardly, and a force transmitting wall surface disposed opposite to said abutment wall surface in the radial direction and abutting against said first inner surrounding surface when said fastener engaging member is forced into said first bore so as to force said abutment wall surface to abut against said deformable member radially and inwardly;

a bit including two screwdriver tip ends axially opposite to each other, and a shaft disposed between and interconnecting said screwdriver tip ends, said shaft being brought to be inserted into said third bore in the axial direction such that one of said screwdriver tip ends is inserted into said second bore, and such that said protrusion of said deformable member frictionally engages said shaft in the radial direction so as to hinder removal of said bit from said fastener engaging member in the axial direction; and a spline member disposed between said shaft and said second inner surrounding surface to couple said shaft to rotate with said fastener engaging member when said handle is rotated about the axis.

2. The hand tool as claimed in claim 1, wherein said deformable member is connected integrally with said abutment wall surface opposite to said protrusion such that said abutment wall surface abuts against said end edge portions of said inner peripheral wall of said fastener engaging member when said deformable member is inserted into said mounting hole.

3. The hand tool as claimed in claim 2, further comprising a pair of sockets formed respectively in said end edge portions and extending inwardly and in the radial direction towards said second inner surrounding surface, and a pair of plugs, each having an upper end which is connected to said abutment wall surface and a lower end which is inserted into a respective one of said sockets in the radial direction when said deformable member is inserted into said mounting hole.

4. The hand tool as claimed in claim 3, wherein said sockets extend to communicate with said second inner surrounding surface, and said lower ends of said plugs are deformable and extend inwardly of said second inner surrounding surface to frictionally engage said shaft in the radial direction.

5. The hand tool as claimed in claim 4, wherein said lower end of each of said plugs has a rounded portion to facilitate insertion of said lower end into the respective one of said sockets.

6. The hand tool as claimed in claim 2, wherein said deformable member further has a tapered portion converging from said abutment wall surface to said protrusion, said end edge portions being provided with two mating walls to matingly engage said tapered portion.

7. The hand tool as claimed in claim 1, wherein said friction member includes a plurality of axially extending serrations formed on said second outer surrounding surface.

8. The hand tool as claimed in claim 1, wherein said second inner surrounding surface has a hexagonal cross-section, and said shaft is of a hexagonal shape to matingly engage and to cooperate with said second inner surrounding surface to serve as said spline member.

9. The hand tool as claimed in claim 1, wherein said spline member includes a pair of keyways formed in said second inner surrounding surface and extending in the axial direction, and a pair of keys disposed on said shaft so as to engage said keyways, respectively.

* * * * *